US006142057A

United States Patent [19]

Schulze

[11] Patent Number: 6,142,057

[45] Date of Patent: Nov. 7, 2000

[54] TUBULAR WEAPON

[75] Inventor: Helge Schulze, Unterlüss, Germany

[73] Assignee: Rheinmetall W & M GmbH, Unterlüss, Germany

[21] Appl. No.: 09/165,276

[22] Filed: Oct. 2, 1998

[30] Foreign Application Priority Data

Oct. 2, 1997 [DE] Germany ..... 197 43 791

[51] Int. Cl.[7] ..... F41A 13/04

[52] U.S. Cl. ..... 89/14.1; 89/16; 29/1.11

[58] Field of Search ..... 89/14.05, 14.1, 89/16; 29/1.11; 42/76.01

[56] References Cited

U.S. PATENT DOCUMENTS

| | | | |
|---|---|---|---|
| 34,472 | 2/1862 | Babbitt | 89/14.1 |
| 335,606 | 2/1886 | Mefford | 89/16 |
| 1,337,971 | 4/1920 | Watkins | 89/14.1 |
| 4,982,648 | 1/1991 | Bol et al. | 89/14.1 |

FOREIGN PATENT DOCUMENTS

| | | | |
|---|---|---|---|
| 1202504 | 1/1960 | France | 89/14.1 |
| 38 27 740 | 2/1990 | Germany . | |
| 487229 | 12/1999 | Germany | 89/14.1 |
| 596425 | 7/1959 | Italy | 89/14.1 |
| 45806 | 3/1915 | Sweden | 89/14.1 |

*Primary Examiner*—Stephen M. Johnson
*Attorney, Agent, or Firm*—Venable; Norman N. Kunitz; Leo J. Jennings

[57] ABSTRACT

A tubular weapon with a weapon tube (1) guided inside a cradle tube (2) which is mounted stationary in axial direction. In order to provide such a tubular weapon with a cooling system (12) between the weapon tube and the cradle tube (1, 2) and to avoid the occurrence of sealing problems in the transition region between the weapon tube and the cradle tube, the cooling system (12) has at least one cooling line (11), which is positioned spirally around the weapon tube (1), and which is connected rigidly to the cradle tube (2).

14 Claims, 1 Drawing Sheet

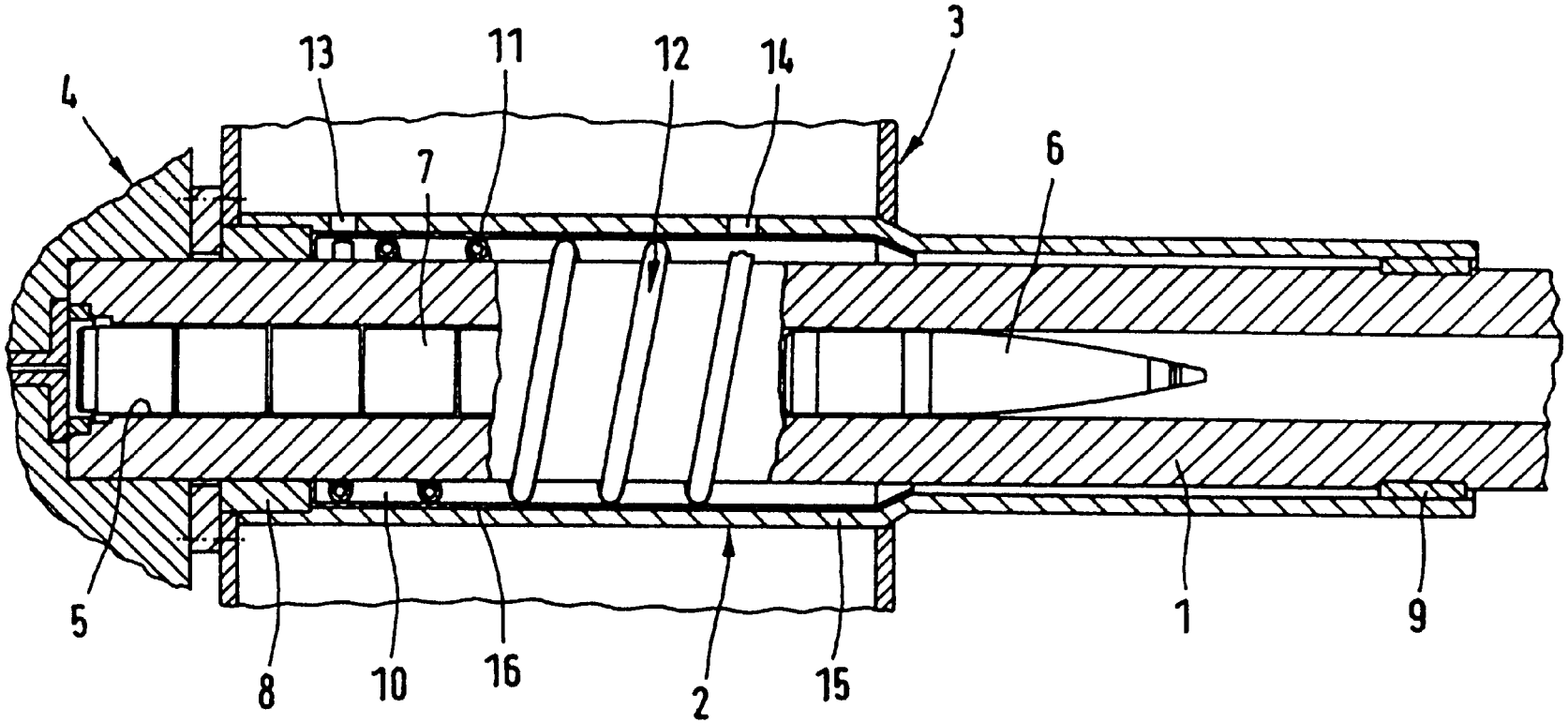
4
13
11
12
14
3
6
7
5
8
10
16
2
15
1
9

TUBULAR WEAPON

REFERENCE TO RELATED APPLICATIONS

This application claims the priority of German application Serial No. DE 197 43 791.5 filed Oct. 2, 1997 which is incorporated herein by reference.

BACKGROUND OF THE INVENTION

The invention relates to a tubular weapon with a weapon tube guided inside a cradle tube which is mounted stationary in the axial direction.

When ammunition is fired from a large-caliber weapon, high combustion temperatures develop inside the chamber and in the adjacent rifled section of the weapon tube, which results in a strong heating up of the tube walls. Thus, with a rapid firing sequence there is danger of the chamber wall temperature reaching the self-ignition temperature of the propellant charge for the respective ammunition. A firing pause is therefore normally scheduled when the tube wall temperature reaches approximately 170° to 190°, so as to allow the tube to cool down.

A cooling system, which is arranged in the chamber region between the cradle tube and the weapon tube and is designed to avoid or reduce the number of firing pauses needed to allow the tube wall to cool down is disclosed in German published patent application DE 38 27 740 A1. This cooling system essentially consists of a continuous hollow space, through which a gaseous or liquid cooling agent can flow, the walls of which are formed by the adjacent surfaces for the cradle tube and the weapon tube.

The disadvantage of this known cooling system is that a relatively involved sealing system is required to avoid, among other things, problems with leaking seals in the frontal transition regions for weapon tube and cradle tube during the recoil and counter-recoil of the weapon.

It is the object of the present invention to provide a tubular weapon having a cooling system by means of which sealing problems in the transition region between the weapon tube and the cradle tube can be avoided safely and in a simple manner.

SUMMARY OF THE INVENTION

The above object generally is achieved according to the present invention in that in a tubular weapon with a weapon tube which is movably guided inside a cradle tube which is mounted stationary in axial direction, a cooling system for cooling of the weapon tube is arranged between the weapon tube and the cradle tube in the chamber region of the weapon, the cooling system comprises at least one cooling line which is guided spirally around the weapon tube in the chamber region and through which a cooling agent can flow, and the cooling line is positioned rigidly inside the cradle tube such that the weapon tube is not hindered during recoil movement or counter-recoil movement. Other advantageous features and embodiments of the invention are disclosed and discussed.

The invention is essentially based on the idea of arranging a cooling system in the chamber region between the weapon tube and the cradle tube, which cooling system basically consists of a cooling line that encloses the weapon tube spirally and which is rigidly connected to the cradle tube.

The use of such a spiral cooling line makes it easy to cool the weapon tube without sealing problems occurring between weapon tube and cradle tube because the respective lines can be extended through the cradle tube and toward the outside. An additional advantage it that the recoil mass of the weapon tube is not increased, owing to the rigid arrangement of the cooling lines with respect to the cradle tube.

When using this cooling system, it is furthermore easy to achieve a directionally controlled cooling of those tube wall regions inside the chamber area which experience a particularly high degree of heating during the firing without a cooling system.

A further reduction in the energy losses for the cooling system can be achieved by installing a heat-insulating or thermal layer between the cooling line and the cradle tube, which for the most part eliminates external thermal influences.

Further details and advantages of the invention result from the following exemplary embodiment, which is explained below in more detail with the aid of a FIGURE.

BRIEF DESCRIPTION OF THE DRAWINGS

The FIGURE is a longitudinal section through the chamber-side region of a loaded, large-caliber weapon e.g., a tank gun.

DETAILED DESCRIPTION OF THE PREFERRED EMBODIMENTS

Referring now to the FIGURE, there is shown the weapon chamber region of a larger caliber weapon wherein the reference numeral 1 refers to the weapon tube, the numeral 2 refers to the tube of a cradle 3 that is needed for the elevation aiming of the weapon tube, and the numeral 4 refers to the breach assembly for the weapon.

The weapon tube 1 has a chamber 5 on the tail side or rear, which chamber houses the projectile 6 as well as several propellant charges 7.

The weapon tube 1 is supported via two bearings 8, 9 on the cradle tube 2, wherein a hollow space 10 remains between the cradle tube 2 and the weapon tube 1 in the chamber region 5, which space 10 houses the spiral-shaped conduit (cooling line) 11 of a cooling system 12. The two end sections 13 and 14 of cooling line 11, through which the gaseous or liquid coolant is supplied or discharged, extend through the tube wall 15 of the cradle tube 2 and are provided, for example, with hose connections that are not shown.

A heat-insulating layer 16 is arranged between the spiral-shaped cooling line 11 and the cradle tube 2, so that the weapon components on the outside (cradle tube, cradle, etc.) do not influence the cooling capacity of cooling system 12.

Together with the heat-insulating layer 16, the cooling line 11 is positioned rigidly and stationary inside the cradle tube 2 and therefore does not belong to the recoil mass. In addition, there is sufficient play between the line 11 and the weapon tube 1, so that the recoil and counter-recoil of the tube 1 are not hindered.

Since large-caliber weapon tubes generally are thick-walled tubes, it will take some time before the cooling effect of the cooling system also affects the inside of the tube 1. It has therefore proven advantageous to cool the weapon tube early, by means of the cooling system 1, in order to compensate for the rise in temperature inside the chamber, which occurs during the firing.

Of course, the invention is not limited to the above-described embodiment. For example, the spiral cooling line can be integrated into the inside wall of the cradle tube 3 to simplify the assembly.

The invention now being fully described, it will be apparent to one of ordinary skill in the art that many changes and modifications can be made thereto without departing from the spirit or scope of the invention as set forth herein.

What is claimed:

1. A tubular weapon capable of being supplied with a cooling agent and having a chamber region and a weapon tube which is movably guided inside a cradle tube which is mounted stationary in an axial direction, and wherein a cooling system for cooling of the weapon tube is arranged between the weapon tube and the cradle tube in the chamber region of the weapon;

wherein the cooling system comprises at least one cooling line separate from the weapon tube and the cradle tube, guided spirally around the weapon tube in the chamber region and through which the cooling agent flows when supplied thereto, and wherein the cooling line is positioned rigidly inside the cradle tube such that the weapon tube is not hindered during recoil movement or counter-recoil movement.

2. A tubular weapon according to claim 1, wherein a space is defined between the weapon tube and the cradle tube in the chamber region of the weapon; and the cooling line is located within the space.

3. A tubular weapon according to claim 2, wherein a heat-insulating layer is disposed in the space between the spiral-shaped cooling line and the cradle tube.

4. A tubular weapon according to claim 3, wherein the cradle tube has a tube wall, and the ends of the cooling line, through which the cooling agent flows into the spiral cooling line or is discharged from the cooling line, extend to the outside through the tube wall of the cradle tube.

5. A tubular weapon according to claim 1, wherein the spiral-shaped cooling line is arranged in a region of the cradle tube in which the weapon tube inside temperature that increases during the firing of the ammunition has the greatest effect on a new propellant charge that is disposed inside the weapon chamber.

6. A tubular weapon according to claim 1, wherein the cradle tube has an inside wall and the spiral-shaped cooling line forms a section of the cradle tube inside wall which is facing the weapon tube, and the ends of the cooling line, through which the cooling agent flows into the spiral cooling line or is discharged from cooling line, extend to the outside through the tube wall of the cradle tube.

7. A tubular weapon according to claim 1, wherein a heat-insulating layer is disposed between the spiral-shaped cooling line and the cradle tube.

8. A tubular weapon according to claim 7, wherein the cradle tube has an inside wall and the spiral-shaped cooling line forms a section of the cradle tube inside wall which is facing the weapon tube, and the ends of the cooling line, through which the cooling agent flows into the spiral cooling line or is discharged from cooling line, extend to the outside through the tube wall of the cradle tube.

9. A tubular weapon according to claim 8, wherein the spiral-shaped cooling line is arranged in a region of the cradle tube in which the weapon tube inside temperature that increases during the firing of the ammunition has the greatest effect on a new propellant charge that is disposed inside the weapon chamber.

10. A tubular weapon capable of being supplied with a cooling agent and having a chamber region and a weapon tube which is movably guided inside a cradle tube which is mounted stationary in an axial direction, and wherein a cooling system for cooling of the weapon tube is arranged between the weapon tube and the cradle tube in the chamber region of the weapon, wherein the cooling system comprises at least one cooling line guided spirally around the weapon tube in the chamber region and through which the cooling agent flows when supplied thereto, wherein the cooling line is positioned rigidly inside the cradle tube such that the weapon tube is not hindered during recoil movement or counter-recoil movement, wherein a space is defined between the weapon tube and the cradle tube in the chamber region of the weapon, and the cooling line is located within the space, and wherein a heat-insulating layer is disposed in the space between the spiral-shaped cooling line and the cradle tube.

11. A tubular weapon according to claim 10, wherein the cradle tube has a tube wall, and the ends of the cooling line, through which the cooling agent flows into the spiral cooling line or is discharged from cooling line, extend to the outside through the tube wall of the cradle tube.

12. A tubular weapon capable of being supplied with a cooling agent and having a chamber region and a weapon tube which is movably guided inside a cradle tube which is mounted stationary in an axial direction, and wherein a cooling system for cooling of the weapon tube is arranged between the weapon tube and the cradle tube in the chamber region of the weapon, wherein the cooling system comprises at least one cooling line guided spirally around the weapon tube in the chamber region and through which the cooling agent flows when supplied thereto, and wherein the cooling line is positioned rigidly inside the cradle tube such that the weapon tube is not hindered during recoil movement or counter-recoil movement, and wherein a heat-insulating layer is disposed between the spiral-shaped cooling line and the cradle tube.

13. A tubular weapon according to claim 12, wherein the cradle tube has an inside wall and the spiral-shaped cooling line forms a section of the cradle tube inside wall which is facing the weapon tube, and the ends of the cooling line, through which the cooling agent flows into the spiral cooling line or is discharged from cooling line, extend to the outside through the tube wall of the cradle tube.

14. A tubular weapon according to claim 13, wherein the spiral-shaped cooling line is arranged in a region of the cradle tube in which the weapon tube inside temperature that increases during the firing of the ammunition has the greatest effect on a new propellant charge that is disposed inside the weapon chamber.

* * * * *